US006869523B2

(12) United States Patent
Martinez

(10) Patent No.: US 6,869,523 B2
(45) Date of Patent: Mar. 22, 2005

(54) CURBSIDE DRAIN BARRIER FOR DETAINING SOLID TRASH DURING NO OR SLOW WATER FLOW

(76) Inventor: Antonio Martinez, 2413 N. Mountain View Rd., El Monte, CA (US) 91733

( * ) Notice: Subject to any disclaimer, the term of this patent is extended or adjusted under 35 U.S.C. 154(b) by 177 days.

(21) Appl. No.: 10/272,449

(22) Filed: Oct. 15, 2002

(65) Prior Publication Data

US 2004/0069697 A1 Apr. 15, 2004

(51) Int. Cl.[7] ..... E03F 5/06

(52) U.S. Cl. ..... 210/121; 210/131; 210/156; 210/163; 404/4

(58) Field of Search ..... 210/156, 163, 210/164, 131, 170, 121, 418; 404/4, 5

(56) References Cited

U.S. PATENT DOCUMENTS

| | | | | | |
|---|---|---|---|---|---|
| 248,559 | A | * | 10/1881 | Jackson | 404/4 |
| 1,245,903 | A | * | 11/1917 | Gross | 210/163 |
| 1,999,637 | A | * | 4/1935 | Pettepher | 210/156 |
| 6,015,489 | A | * | 1/2000 | Allen et al. | 210/131 |
| 6,217,756 | B1 | * | 4/2001 | Martinez | 210/163 |
| 6,726,402 | B1 | * | 4/2004 | Martinez | 210/163 |
| 6,733,665 | B1 | * | 5/2004 | Khalil | 210/156 |

* cited by examiner

*Primary Examiner*—Christopher Upton
(74) *Attorney, Agent, or Firm*—Donald D. Mon

(57) ABSTRACT

A system to exclude trash from curbside drains during periods of no or slow water flow, but opening to permit full entry during heavier flow such as during heavy rains. The system may have a linkage preventing opening by force on its barrier, and to assure that it will remain open should downstream drainage systems become flooded.

7 Claims, 9 Drawing Sheets

CURBSIDE DRAIN BARRIER FOR DETAINING SOLID TRASH DURING NO OR SLOW WATER FLOW

FIELD OF THE INVENTION

A barrier installed in a curbside drain opening which detains solid trash from entering the drain when there is no or slow water flow, but which opens fully when a sufficiently high water flow rate occurs.

BACKGROUND OF THE INVENTION

A barrier installed in a curbside drain opening which detains solid trash at no or slow rate flow rates, but which opens when the rate is sufficiently high, is shown in Martinez U.S. Pat. No. 6,217,756. The objective of this patent, and of the instant invention, is to impede the entrance of solid trash into the drain from a gutter while permitting slow water flow, and to open up when the flow is heavy so as to pass it.

Of course, when a heavy flow of water arrives and the barrier opens, whatever solid trash is already detained at the opening, or is up the gutter, will be washed into the drain. However, when there is no flow, or only slow flow, the detained trash can readily be swept away by a street sweeper. In effect, this barrier keeps out of the downstream drain system trash which accumulates during dry periods if the street is properly swept.

Municipalities are well aware of the costs when trash enters a drainage system. Generally there is a catch basin into which water and trash that passed through the drain opening are deposited. This trash must be removed, usually on a periodic basis. A heavy cover is removed, and then depending on what is in there, a man must go into the basin properly equipped to clear it out. If for some reason the basin is not properly cleaned out, and a rapid flow of water arrives, the drain can be plugged, and a flood ensues. Proper maintenance is necessary.

Of even greater concern is what arrives downstream from the basin. Sooner or later, all material that is not removed near the source will reach a water system. In some states this is a river or lake. In others it is an ocean or a bay. In every such situation, there result troublesome accumulations of trash and often pollution. These events often occur at places where it is difficult to retrieve the trash, and sometimes it is too late, especially when soluble or small particles are involved and they are dispersed into the environment.

To counter the risk, and depending on the scope of the drainage system, catch dams are often provided downstream which must periodically be cleaned out at great expense. It is best practice to exclude trash from them to the maximum extent possible while they are dry, and while the trash is readily accumulated in condition for easier collection at the curbside.

Still, means for this purpose should not interfere with the primary objective of the drainage system, which is to protect the surrounding area against flooding when the flow is heavy, such as in hard rainstorms or thunderstorms. In those events, the system must be maximally open and cannot be permitted to plug up. Apparatus according to this invention helps to assure system open-ness, because it can prevent most of the trash from entering the system in the first place.

An inherent problem with known devices such as in the aforementioned Martinez patent is that, while they need to remain open during times of heavy flow, they should close when the flow slows, but still stay open in case the system has already opened and then backs up and floods the catch basin. The said patented device can lose its control function when the system backs up, and the barrier can close, which can result in a flooded condition.

It is an object of this invention to provide a barrier that is normally closed during no or slow water flow rates, is reliably open when the rates increase, and reliably closes when the water in the basin recedes.

Optionally, means can be provided to keep the barrier open whenever the water level in the basin rises above some reference level and there may be no adequate flow past the control to keep the barrier open. With this improvement the system's control devices cannot be overwhelmed by being immersed in standing water in a flooded basin.

BRIEF DESCRIPTION OF THE INVENTION

Apparatus according to this invention is intended to be installed in a curbside drain opening. Such openings receive water from a gutter, which often entrains solid trash such as leaves, cuttings, bottles, and papers. The opening is usually vertical and rectangular. At its lower edge is a lip across which water and whatever else is carried by it, will flow and pass.

The apparatus is installed as a controllable barrier between the gutter and a catch basin. Such a catch basin is generally accessible from above, open to flow from the opening and connected to a downstream drainage system. Such systems customarily drain to a place where rainfall ultimately arrives—a water treatment facility, a river, a bay, or an ocean.

These systems can be clogged up by trash at any point. It is best practice to keep the trash out as much as possible. According to this invention, the barrier of this invention stays closed when there is no or only slow water flow. This will exclude trash from the system, while permitting the flow of water at lesser flow rates. Trash detained in the gutter can be swept away at any time without entering the catch basin or anyplace else in the system.

According to this invention, the barrier is pivotally mounted to structure surrounding the curbside drain, adapted to remain across the drain opening when there is no or only slow flow of water from the gutter. Linkage is mounted to the structure and to the barrier to rotate the barrier between closed and opened positions.

An actuator responsive to the flow rate of water through the opening is positioned inside of the basin below the lower edge of the opening, where water flow at a higher flow rate will flow into a receptacle, but water at a slower rate will not. The actuator includes a receptacle which, when sufficiently filled, will cause the actuator to move the linkage and open the barrier.

According to this invention, as soon as the barrier is opened, the receptacle will tilt and dump its load of water. This eliminates the weight which opened the barrier. Without further provisions, the barrier would simply be closed again, even if the water flow continued. It is a feature of this invention that, after the receptacle has dumped its contents, it remains effective on the actuator so long as a sufficient water flow impacts on it.

Then, as an additional but optional feature, should the receptacle be immersed in a flooded basin, means can be provided to hold the barrier open until the water in the basin recedes below the flooded level.

The above and other features of this invention will be fully understood from the following detailed description and the accompanying drawings, in which:

DETAILED DESCRIPTION OF THE INVENTION

Figure 1:
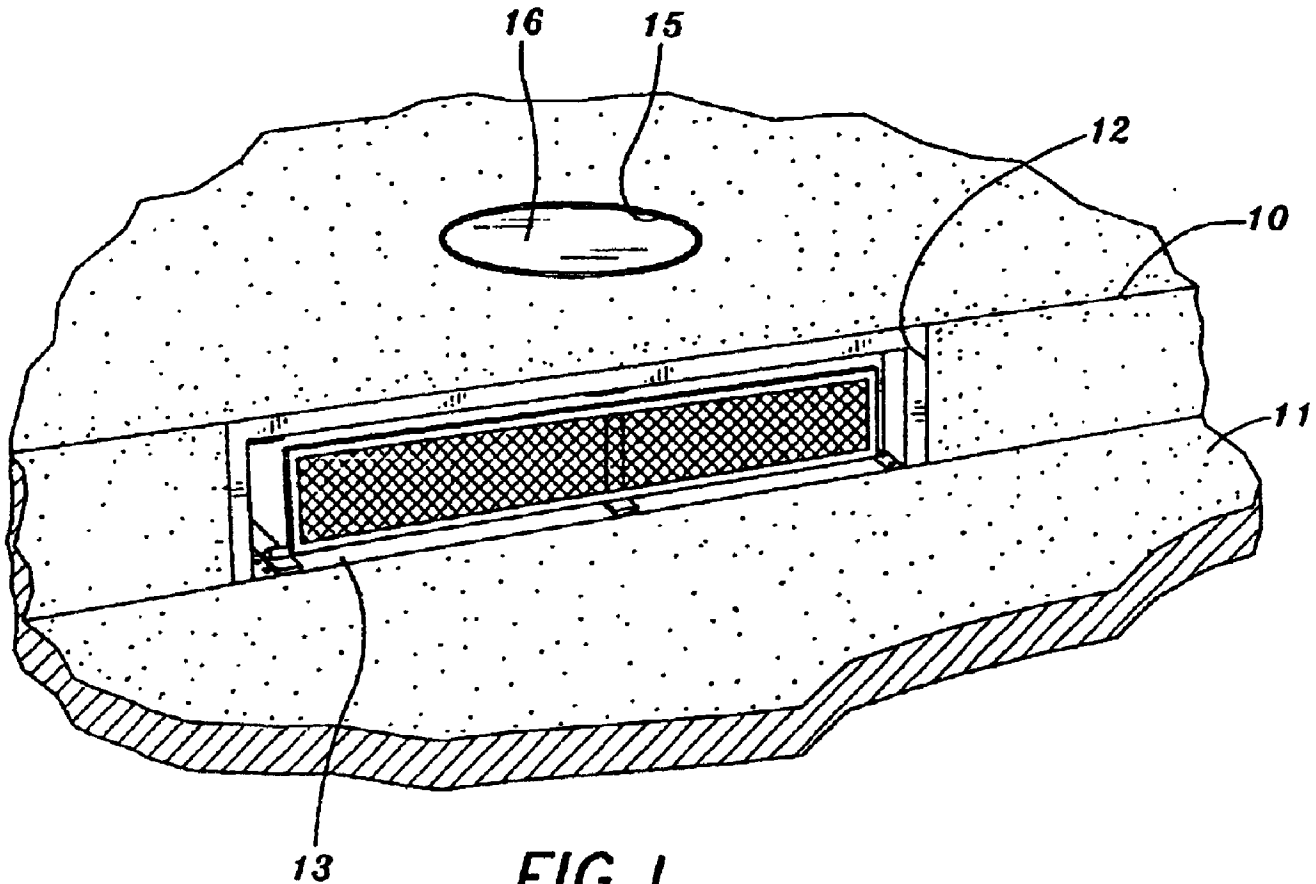
FIG. 1 is a fragmentary perspective view of a region incorporating the invention.

A typical installation for this invention is shown in FIG. 1. A curb 10 next to a gutter 11 has a drain opening 12 which is usually rectangular. The opening has a bottom edge 13 over which water will follow when it enters the opening.

Figure 3:
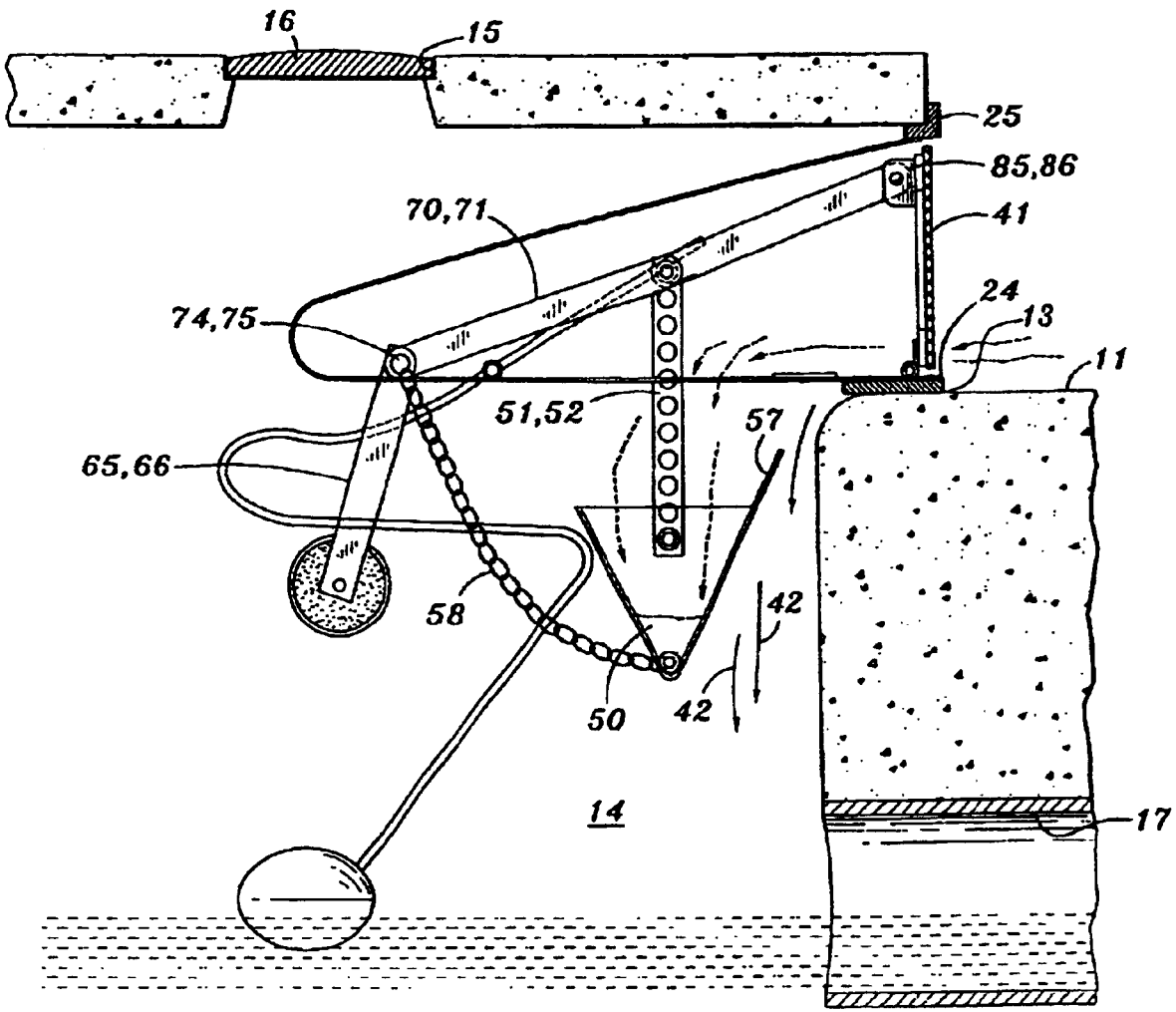
FIG. 3 is a right hand side view of the apparatus of FIG. 2 in its closed condition.

In turn the opening enters into a catch basin 14 (FIG. 3). Essentially this is a small "room" with a top in which a manhole 15 or other entry arrangement is fitted with a removable cover 16. From the catch basin, a conduit 17 leads into a drainage system, usually a storm drain intended to carry away water at flow rates which, if not carried away would flood surrounding areas. As stated before, these basins must be kept free of amounts of trash that could clog them, or depending on the nature of the trash, contaminate or cause flooding downstream.

Although the individual parts of the apparatus could be directly attached to structure of the curb and of the basin, it is best manufacturing procedure to provide a structure which can be fitted in or attached to the surrounding opening.

Figure 2:
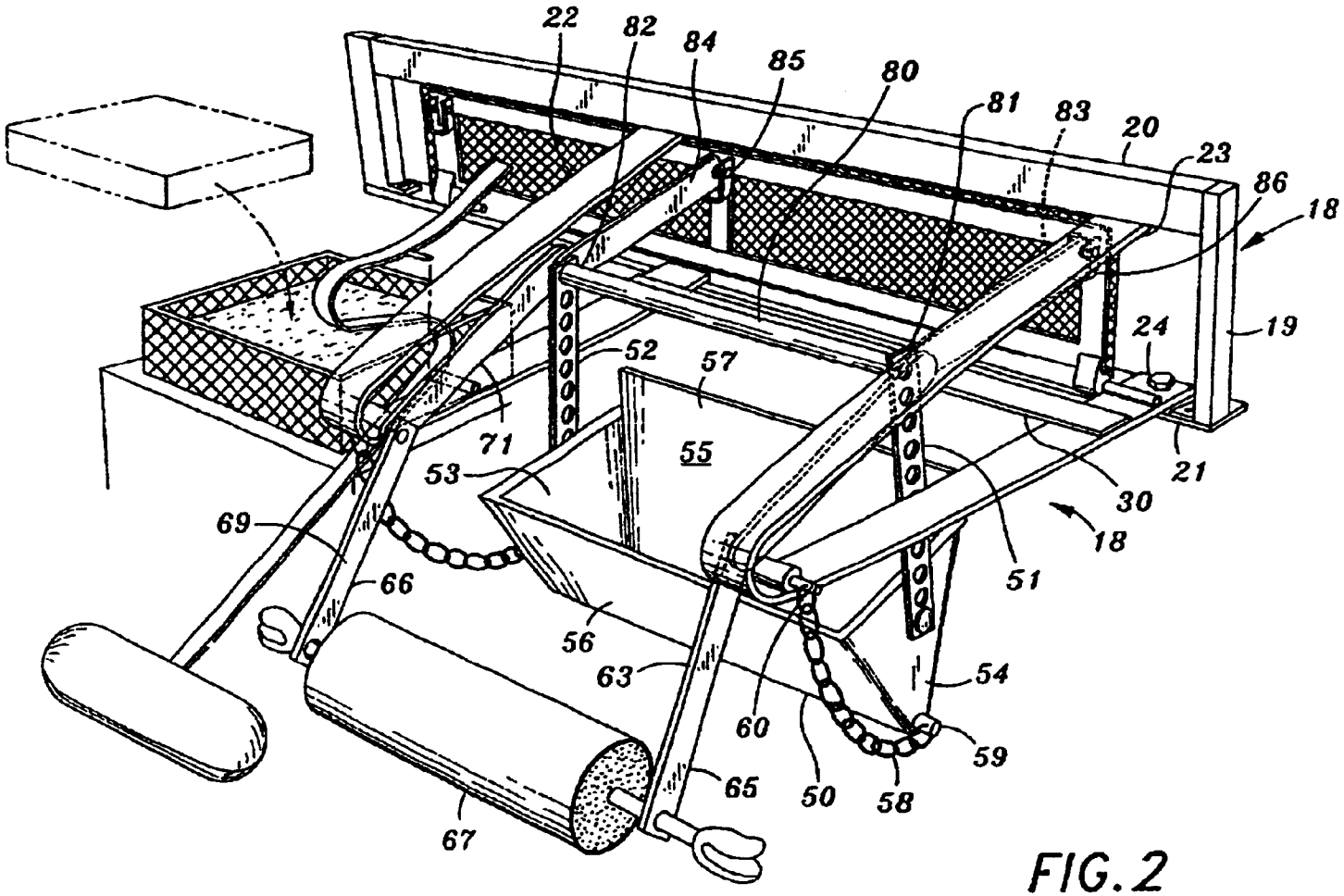
FIG. 2 is a perspective inside view showing the presently-preferred embodiment of the invention installed in a catch basin.
Figures 7, 8:
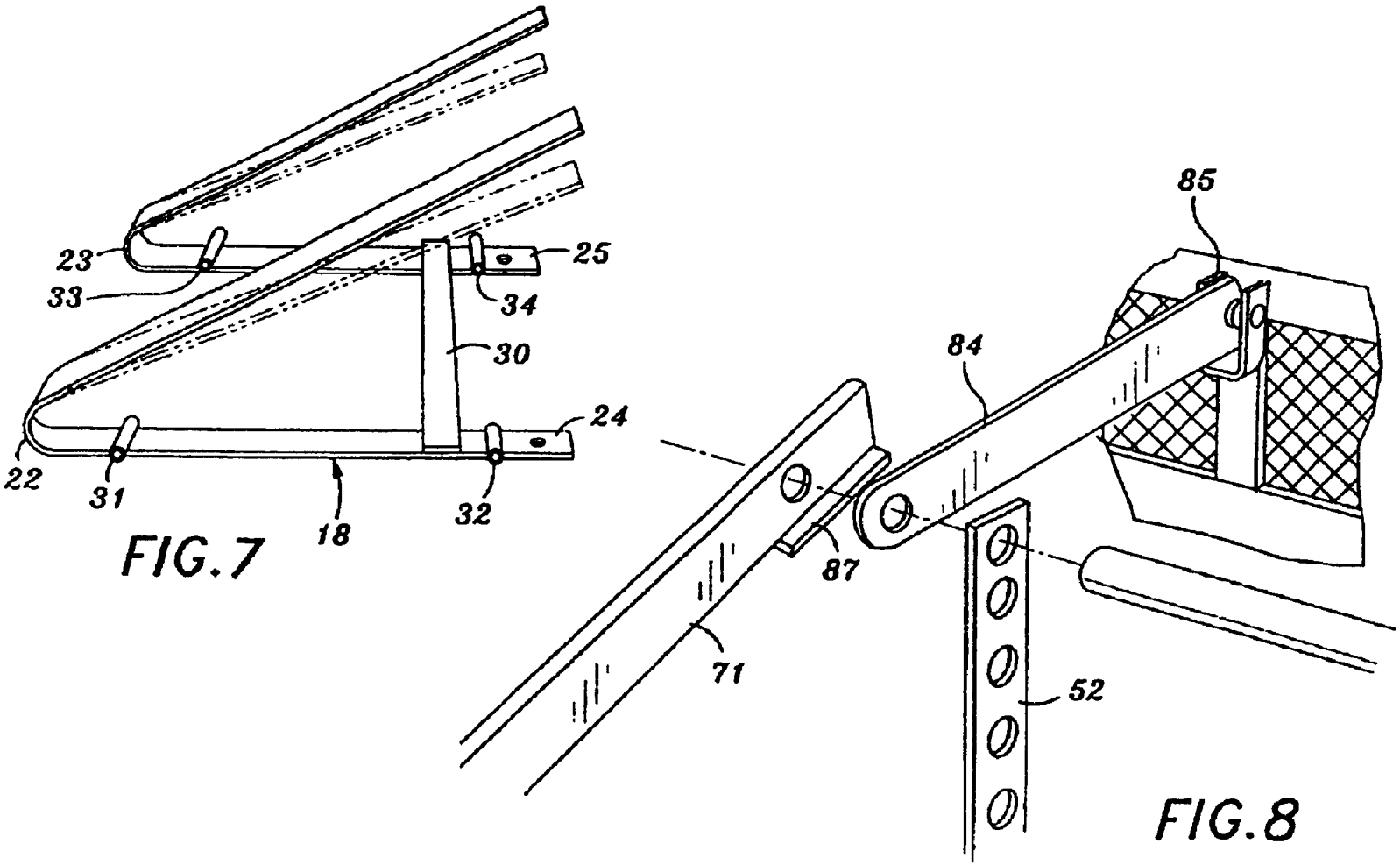
FIG. 7 is a perspective view of a frame useful in this apparatus.
FIG. 8 is an exploded view showing the relationship of several parts of the apparatus.

A frame 18 (FIGS. 2, 3 and 7) includes two springy mounting arms 22, 23 formed to a V-shape. Brackets 24, 25 are attached to the arms so this structure can be attached to the wall of the drain opening. As shown in FIG. 7, these arms are springy, so as to cause them when installed to bear strongly against the wall of the drain opening. The dashed lines in FIG. 7 show the distorted, installed free ends, while in solid line are shown the undistorted ends prior to installation.

A brace 30 is attached to the two mounting arms to hold the base together. Attachment pins 31, 32, 33 and 34 provide for attachments which will later be described.

Barrier 41 is a flat structure with dimensions of length and of height. It is pivoted to pins 32 and 34 at the bottom edge 13 of the opening. When erect the barrier will occlude the opening, at least in part. It may conveniently be a grating or a grid of rods or wires, or a screen, depending on what is anticipated to be the type of trash to be detained and the anticipated rates of flow. In any event, some kind of space or clearance next to, beside or below the barrier, will be provided to enable the slow flow of water past the barrier when it is closed, and over edge 13.

The slow flow (FIG. 3) is designated by arrows 42. This slow flow simply drips over the bottom edge, and into the basin, without having any effect on this device. Except, of course that trash which it brings to the opening will be detained by the closed barrier.

Importantly, at this time the barrier is locked closed. Attention is called to the over-center alignment of arms to be described as best shown in FIG. 3. As will later be shown, mechanical forces against it will not open it. Most importantly, brooms or sweepers can sweep past it to carry away the trash without opening the barrier. Thus, the system's trash load is greatly reduced. The only trash which will ultimately enter the catch basin is what is present in the gutter when heavy water flow occurs. The trash load for what is most of the rest of the year will be excluded from the catch basin, and thereby from the rest of the system.

There remains to be disclosed the controls to maintain the drainage system mechanically closed to entry of trash while permitting slow flow of water, to open it while the flow is rapid, and to keep the closure open when the drainage system itself is flooded.

A tiltable receptacle 50 is pivotally supported from a pair of suspensions 51, 52 that are hinged to the end walls 53, 54 of the receptacle. The receptacle is an open topped container, preferably V-shaped, with a pair of side faces 55, 56 and the two end walls. A bias flange 57 extends beyond side face 55 for a purpose to be described.

A trip chain 58 extends between an attachment point 59 near the bottom apex of the receptacle, and pin 60 on an arm of the frame. There preferably will be one of these chains at each end of the receptacle.

Actuator links 65, 66 are mounted to arms 22, 23 at each side. Together they mount and support a counterweight 67. These links include identical levers 68, 69 with rigidly joined arms 70, 71. These arms rotate with the counterweight. Pivot points 74, 75 mount these links to the arms at their joinder.

A pivot bar 80 extends between the joinders 81, 82 of the links 65 and 66 and mounting links 83, 84. Mounting links 83 and 84 are hinged to the suspensions 51, 52 and to brackets 85, 86 (FIG. 8) on the closure. A limit flange 87 extends from arm 71 to contact arm 84 to limit the upward movement of suspension 52.

The operation of this device as described to this point is as follows. Starting with the closed condition of FIG. 3, the barrier is erect, and solid trash (not shown) will be detained in the gutter. Slow flow 42 of water drips over edge 13, and does not enter the receptacle. This is the normal condition. The slow flow often will come from over-watering of lawns, the washing of cars, and light rains.

Figure 4:
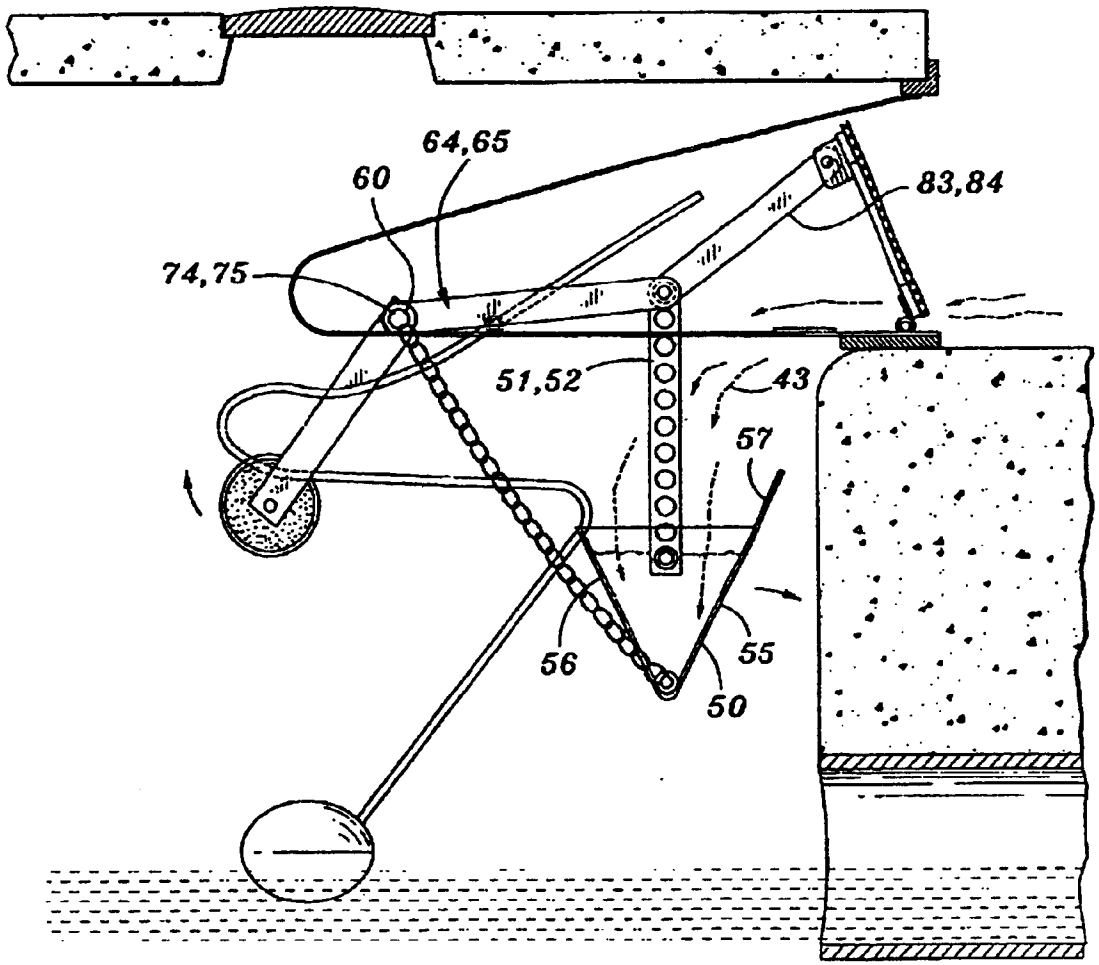
FIG. 4 is a right hand side view of FIG. 3, showing the system starting to open.

Heavier flows 43, as shown in FIG. 4 will not only drip over the edge, but will project into the system, where some of it will fall into the receptacle. There it will accumulate and start to overcome the counterweight. Notice that until this time, as in FIG. 3, force against the barrier was resisted by the aligned link elements, preferably with a slight over-center alignment.

The accumulated weight of water pulls down on the linkage, raises the counterweight and starts to open the barrier. Notice that the water continues to pour into the receptacle. The receptacle does not have a drain.

Figure 5:
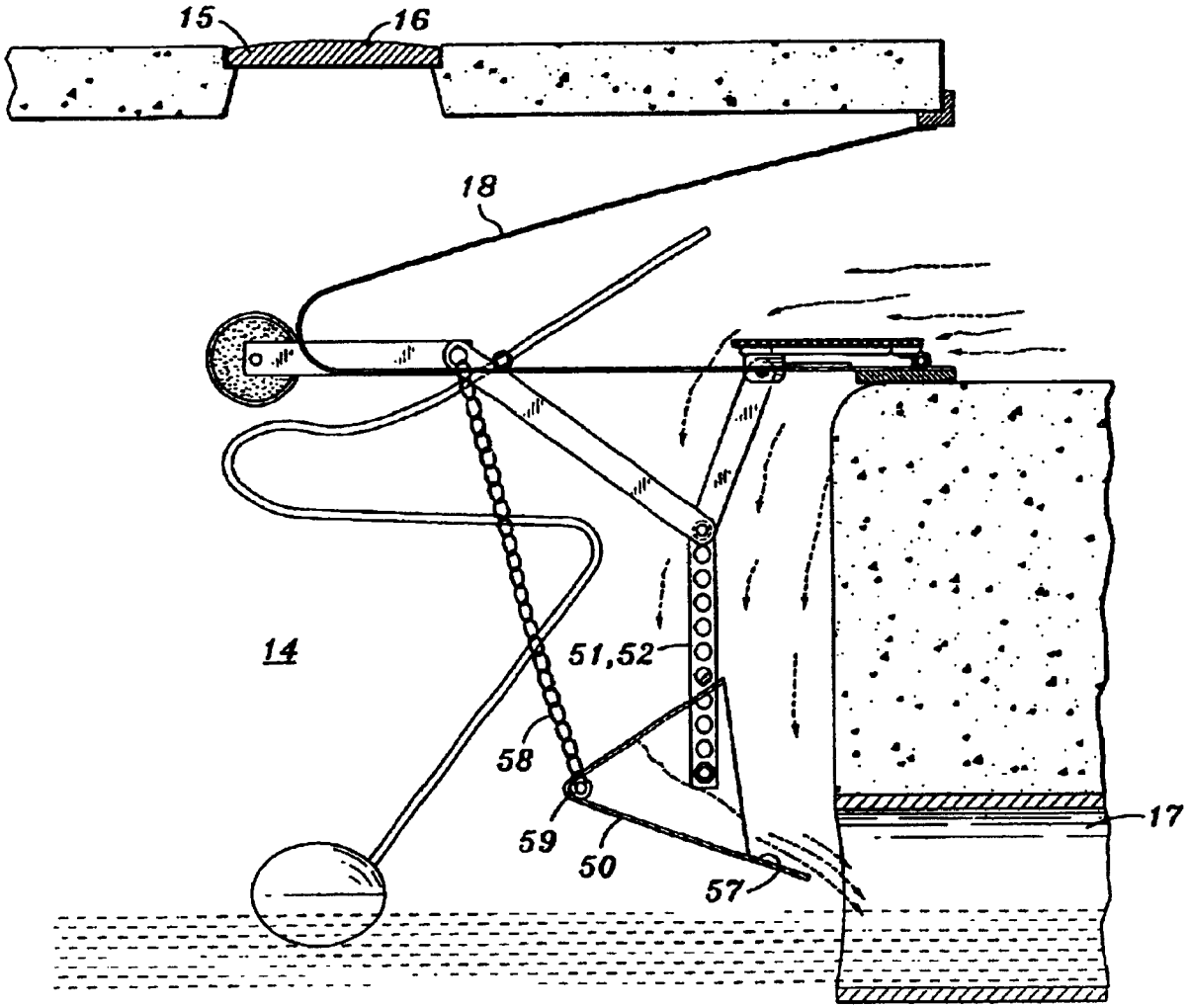
FIG. 5 is a right hand view showing the system fully open in a continuing rapid flow of water.

Next, as the receptacle fills sufficiently, the chain and the suspension are lowered. Soon the chain will trip the receptacle to the tilted position of FIG. 5. One would expect the loss of weight in the receptacle to enable the counterweight to close the barrier. It would, except that with sufficiently high rates of flow, water will cascade down onto bias flange 57. Its force on the flange will hold the receptacle in the tilted position, and the barrier open, so long as the high rate of flow persists (FIG. 5). When it stops, the counterweight will again return the system to its closed position, because the receptacle is empty, or sufficiently empty as to enable the closure to occur.

Figure 9:
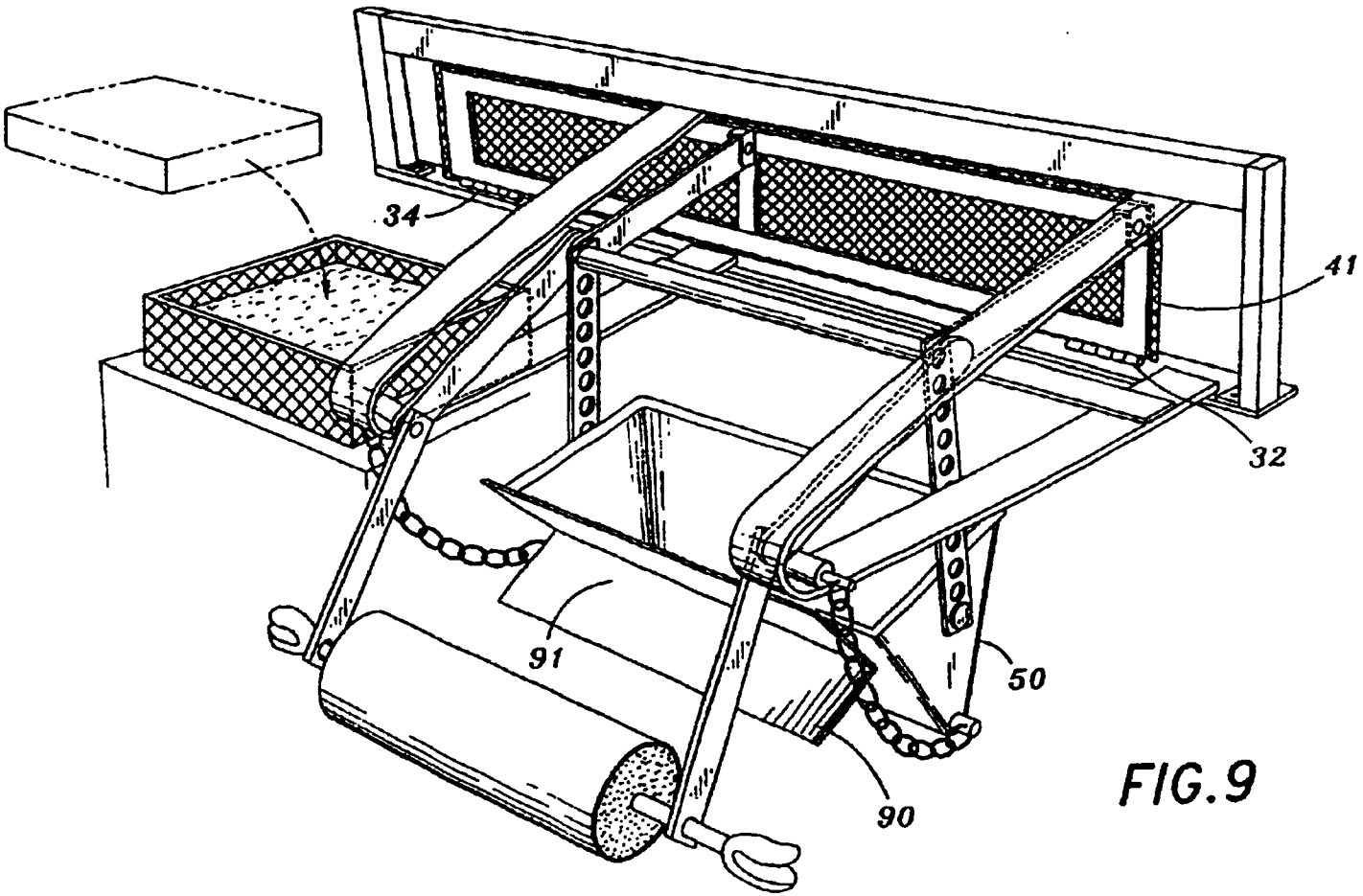
FIG. 9 is a perspective view as in FIG. 2, showing a modified part of the apparatus, the system being closed.
Figure 10:
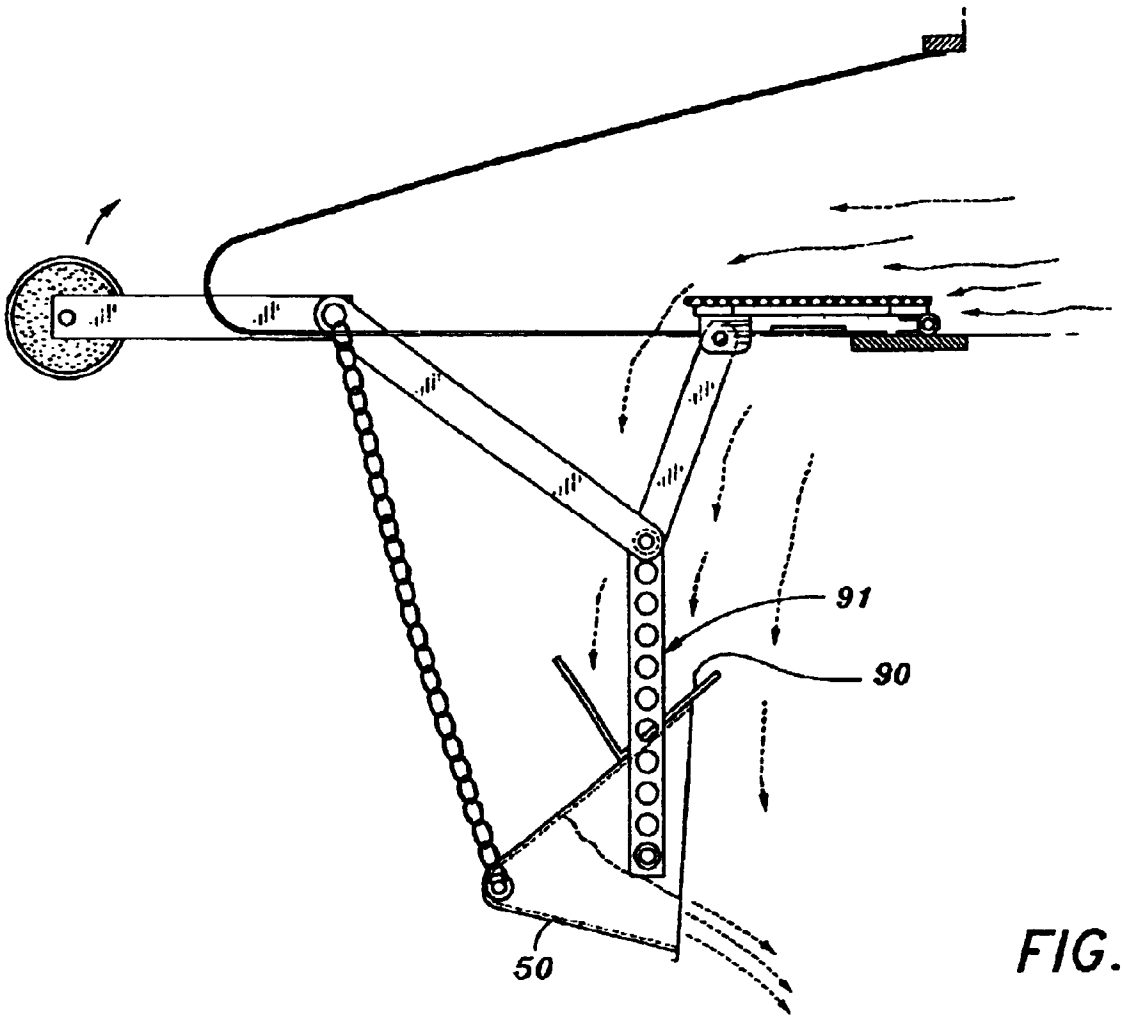
FIG. 10 is a side view of a portion of FIG. 9, showing the system fully open.

FIGS. 9 and 10 show that, instead of a bias flange on the receptacle facing the curbside, a lip 90 can be placed on the backside of the receptacle, preferably forming an open ended trough 91. This trough will also be impacted by high rates of flow, and will tend to keep the barrier from closing, as before.

Figure 6:
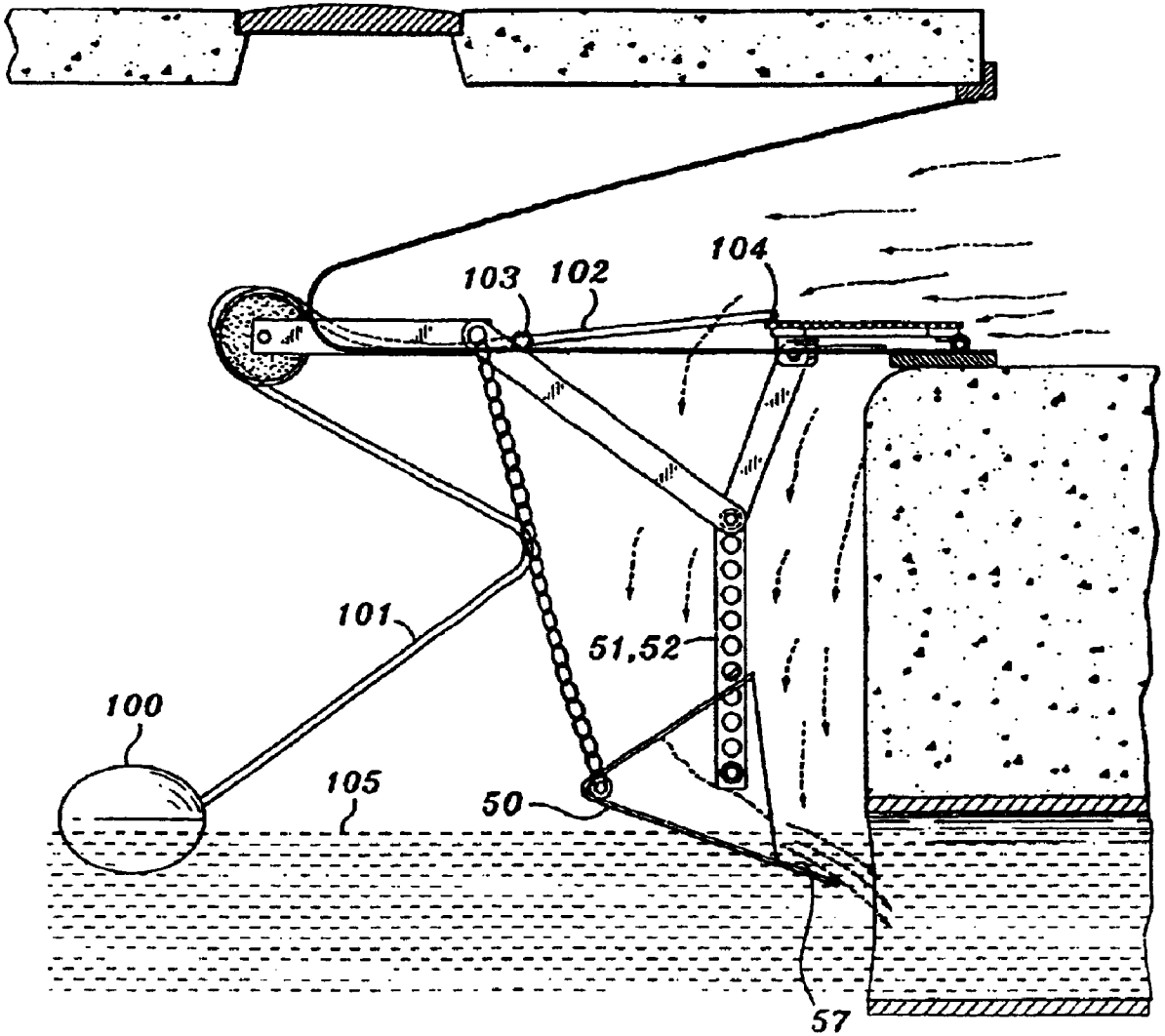
FIG. 6 is a right hand side view showing a flooded-out condition.

FIG. 6 illustrates a latch-open feature of the invention which will be effective to keep the barrier open when the downstream system in the catch basin is flooded. A float 100 is supported by arm 101. A second arm 102 rigidly attached to arm 101 forms a lever. The arms are pivotally mounted to the frame at hinge 103. A catch surface 104 on arm 102 can overlap the edge of the open barrier when the water level 105 in the catch basin rises to the extent shown, before it can flood out the receptacle. If the water rises above that, the float and catch surface keep the closure open so the flooding of the basin will not affect the closure.

This invention is not to be limited by the embodiments shown in the drawings and described in the description, which are given by way of example and not of limitation, but only in accordance with the scope of the appended claims.

I claim:

1. A barrier system which closes to exclude trash and debris from passing through an opening when accompanied by water flowing at an acceptably slow or slower rate of flow, and which opens to permit passage of such material and water when the flow rate of the water is at a faster rate which equals or exceeds said acceptable rate, said opening formed in rigid structure where it will receive said water, said system comprising:

a barrier hingedly mounted to said structure having a closed position across said opening and an open position rotatable to a position where it does not substantially occlude said opening, said system forming gaps at said opening permitting flow of water past said barrier while the flow rate is acceptable and barrier is therefore in its closed position;

a receptacle having side walls, a closed bottom, an open top, and end walls;

a linkage system mounted adjacent to said opening on the downstream side of said barrier comprising a base attached to structure adjacent to said opening, a lever mounted to said base forming a pair of lever arms, a counterweight supported by one of said lever arms, a link pivotally joined to the other of said lever arms and to an edge of said barrier, said link and said other lever arm being pivotally joined by an actuation pivot, a suspender pivotally mounted to said actuation pivot and to an end wall of said receptacle, a trip chain connected to said base and to said receptacle near its bottom, below the point of attachment of said suspender to said end walls;

said linkage being so disposed and arranged that the side wall of said receptacle closer to structure adjacent to said opening is spaced far enough away that the receptacle will not receive water at or below said acceptable rate, but will receive it at higher flow rates, sufficiently high flow rates causing said receptacle to accumulate enough water to overcome the counterweight, and then move the barrier to its open position, said trip chain tilting the receptacle when the barrier opens the opening to dump water from the receptacle.

2. Apparatus according to claim 1 in which said edge of said receptacle closest to said opening includes a bias flange extending beyond it into the path of water flowing at said higher rate to hold the receptacle in its tilted position and the barrier in its open condition while said higher rate persists.

3. Apparatus according to claim 1 in which said linkage is installed in a basin subject to flooding, and in which latch means is provided to hold the barrier in its open position while the basin is flooded.

4. Apparatus according to claim 3 in which said latch means comprises a lever mounted to said base, said lever supporting a float, and having a latch arm adapted to overlap said barrier when open and the basin is flooded, said float normally being at a level below an anticipated flood level with the latch surface disengaged, and adapted to float when flooded to move the latch surface to engage the barrier.

5. Apparatus according to claim 1 in which said lever and said link form a direct link or over center linkage when the barrier is in its closed position to resist opening of said barrier by a force exerted directly on the barrier.

6. A barrier system which closes to exclude trash and debris from passing through an opening when accompanied by water flowing at an acceptably slow or slower rate of flow, and which opens to permit passage of such material and water when the flow rate of the water is at a faster rate which equals or exceeds said acceptable rate, said opening formed in rigid structure where it will receive said water, said system comprising:

a barrier hingedly mounted to said structure having a closed position across said opening and an open position rotatable to a position where it does not substantially occlude said opening, said system forming gaps at said opening permitting flow of water past said barrier while the flow rate is acceptable and said barrier is therefore in its closed position;

a linkage system mounted adjacent to said opening on the downstream side of said barrier responsive to the rate of flow adapted to open the barrier at flow rates higher than said acceptable rate, and to maintain it closed at no or lesser rates of flow, said system discharging into a basin provided with drainage, but subject to flooding; and a latch provided to hold the barrier in its open position while the basin is flooded.

7. Apparatus according to claim 6 in which said latch comprises a lever mounted to said base, said lever supporting a float, and having a latch arm adapted to overlap said barrier when the barrier is open and the basin is flooded, said float normally being at a level below an anticipated flood level with the latch surface disengaged, and adapted to float when flooded to move the latch surface to engage the barrier.

* * * * *